US005874921A

United States Patent [19]

Doherty et al.

[11] Patent Number: 5,874,921

[45] Date of Patent: Feb. 23, 1999

[54] ANTENNA IMPEDANCE MATCHING NETWORK REQUIRING NO SWITCH CONTACTS

[75] Inventors: Peter James Doherty, Apex; Darrell Epperson, Wake Forest, both of N.C.

[73] Assignee: Ericsson, Inc., Research Triangle Park, N.C.

[21] Appl. No.: 717,462

[22] Filed: Sep. 20, 1996

[51] Int. Cl.[6] ..... H01Q 1/24

[52] U.S. Cl. ..... 343/702; 343/749; 343/860; 343/895

[58] Field of Search ..... 343/702, 749, 343/752, 900, 901, 895, 860, 861; H01Q 1/24

[56] References Cited

U.S. PATENT DOCUMENTS

| | | | |
|---|---|---|---|
| 2,719,920 | 10/1955 | Ellis | 343/749 |
| 4,862,182 | 8/1989 | Egashira | 343/702 |
| 4,868,576 | 9/1989 | Johnson, Jr. | 343/702 |
| 4,890,114 | 12/1989 | Egashira | 343/702 |
| 5,212,491 | 5/1993 | Chin et al. | 343/745 |
| 5,374,937 | 12/1994 | Tsunekawa et al. | 343/702 |
| 5,546,094 | 8/1996 | Egashira | 343/702 |
| 5,659,889 | 8/1997 | Cockson | 343/702 |

FOREIGN PATENT DOCUMENTS

| | | |
|---|---|---|
| 0 343 465 | 11/1989 | United Kingdom . |
| 2 253 949 | 9/1992 | United Kingdom . |
| 96 24962 A | 8/1996 | WIPO . |
| 97 20360 A | 6/1997 | WIPO . |

*Primary Examiner*—Michael C. Wimer
*Attorney, Agent, or Firm*—Jenkens & Gilchrist

[57] ABSTRACT

An apparatus for providing an antenna impedance matching network that does not include mechanical switch contacts is disclosed. A retractable antenna includes a conductive plate moveable between the extended and retracted positions of the antenna. When the conductive plate is located in the extended position an impedance matching circuit responsive to the position of the conductive plate is connected between the antenna and an amplifier of a radio telephone. In response to location of the conductive plate in the retracted position, the impedance matching circuit is shorted out such that the antenna is connected directly to the amplifier via a capacitive effect between the conductive plate and a conductive coil of the shorted out impedance matching circuit.

20 Claims, 4 Drawing Sheets

ANTENNA IMPEDANCE MATCHING NETWORK REQUIRING NO SWITCH CONTACTS

BACKGROUND OF THE INVENTION

1. Technical Field of the Invention

The present invention relates to retractable antennas, and more particularly, to an apparatus for connecting an impedance matching network with a retractable antenna.

2. Description of Related Art

The performance of an antenna is determined by its impedance which is dependent upon its wavelength. A retractable antenna inherently performs differently in the extended and retracted positions since the effective wavelength of the antenna is greater in the extended position then in the retracted position. Presently existing retractable antennas normally consist of a quarter wavelength helical coil connected with a quarter wavelength rod. The amplifiers connected to antennas normally are matched to approximately a 50 Ω output impedance. When the antenna is retracted, the quarter wavelength rod is shorted to ground while the quarter wavelength helical coil is directly connected to the amplifier output. The load impedance provided by the quarter wavelength helical coil is approximately equal to the 50 Ω load impedance required by the amplifier. Thus, the impedances match and maximum signal transfer is achieved. However, when the antenna is extended, the quarter wavelength helical coil and quarter wavelength rod present a high load impedance for connection to the amplifier output. This creates unequal impedance matches between the load impedance of the antenna and the load impedance required by the RF amplifier.

To produce similar antenna performance in both the extended and retracted positions, an impedance matching network must be switched into place when the antenna is in the extended position to match to the impedance load of the antenna. Present solutions to this problem have incorporated an electromechanical switch connector to connect high and low impedance matching circuits between the antenna and the amplifier. The quarter wavelength rod portion of an antenna includes upper and lower contact points. In the extended antenna position, the lower contact on the quarter wavelength rod contacts the connector for a high impedance matching circuit connecting the high impedance circuit between the antenna and the amplifier. In the retracted position, the upper antenna contact connects with a low impedance matching circuit, while the low contact connects with a ground connector. This effectively isolates the quarter wavelength rod from the amplifier and provides an equivalent low impedance connection from the helical coil to the output of the amplifier.

However, this solution suffers from several drawbacks. The connectors of this type of network are sensitive to corrosion, fatigue, and tolerance buildup. Thus, they have a high degree of likelihood of mechanical failure. Furthermore, testing of a radio telephone during manufacture is difficult with this type of network, since the impedance matching network is only activated by the insertion of an antenna element into the radio telephone. Thus, no convenient 50 Ω RF feedpoint at the radio telephone is available for testing. It is highly desirable to include a 50 Ω feed point at the antenna port that does not include any matching networks for the antenna. Thus, an antenna impedance matching network that requires no switch contacts and enables connection of test equipment directly to a 50 Ω output feed point during manufacture would be highly desirable.

SUMMARY OF THE INVENTION

The present invention overcomes the forgoing and other problems with an antenna impedance matching network that requires no switch contacts in order to match the impedance of an antenna in the extended and retracted positions. The apparatus includes a conductive plate which is placed between the quarter wavelength rod and quarter wavelength helical coil of a retractable antenna. The conductive plate moves between an extended and a retracted position in response to movement of the antenna. An impedance matching network consists of a second nonconductive plate made from a insulated material having an opening therein for the retractable antenna. A connector within the opening provides interconnection between the antenna and a conductive coil trace on the top surface of the nonconductive plate. On the bottom surface of the nonconductive plate is an RF feedline connected to the conductive coil trace by a conductive via passing through the nonconductive plate. The bottom surface of the nonconductive plate also includes a ground trace covering substantially the entire surface thereof.

When the antenna and conductive plate are located in the extended position, an impedance matching network is connected between the antenna and an amplifier circuit within the radio telephone. The impedance matching circuit consists of the conductive coil trace and a capacitor formed by the capacitive effect between the conductive coil trace on the top side of the nonconductive plate and the ground trace on the bottom side of the nonconductive plane. The conductive coil and capacitive effect generate a high impedance matching circuit which matches to the impedance of the antenna to the load impedance required by the radio telephone.

Location of the conductive plate and antenna in the retracted position shorts out the impedance matching circuit. This is due to a capacitive effect between the conductive plate and adjacent turns of the conductive coil trace. This same capacitive effect generates a connection between the conductive plate and the entire conductive coil trace such that the antenna and the RF feed line are electrically coupled together. The capacitor effect arise from the fact that the conductive plate and the conductive coil trace act as opposed plates of a capacitor.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION OF THE DRAWINGS

Figure 1:
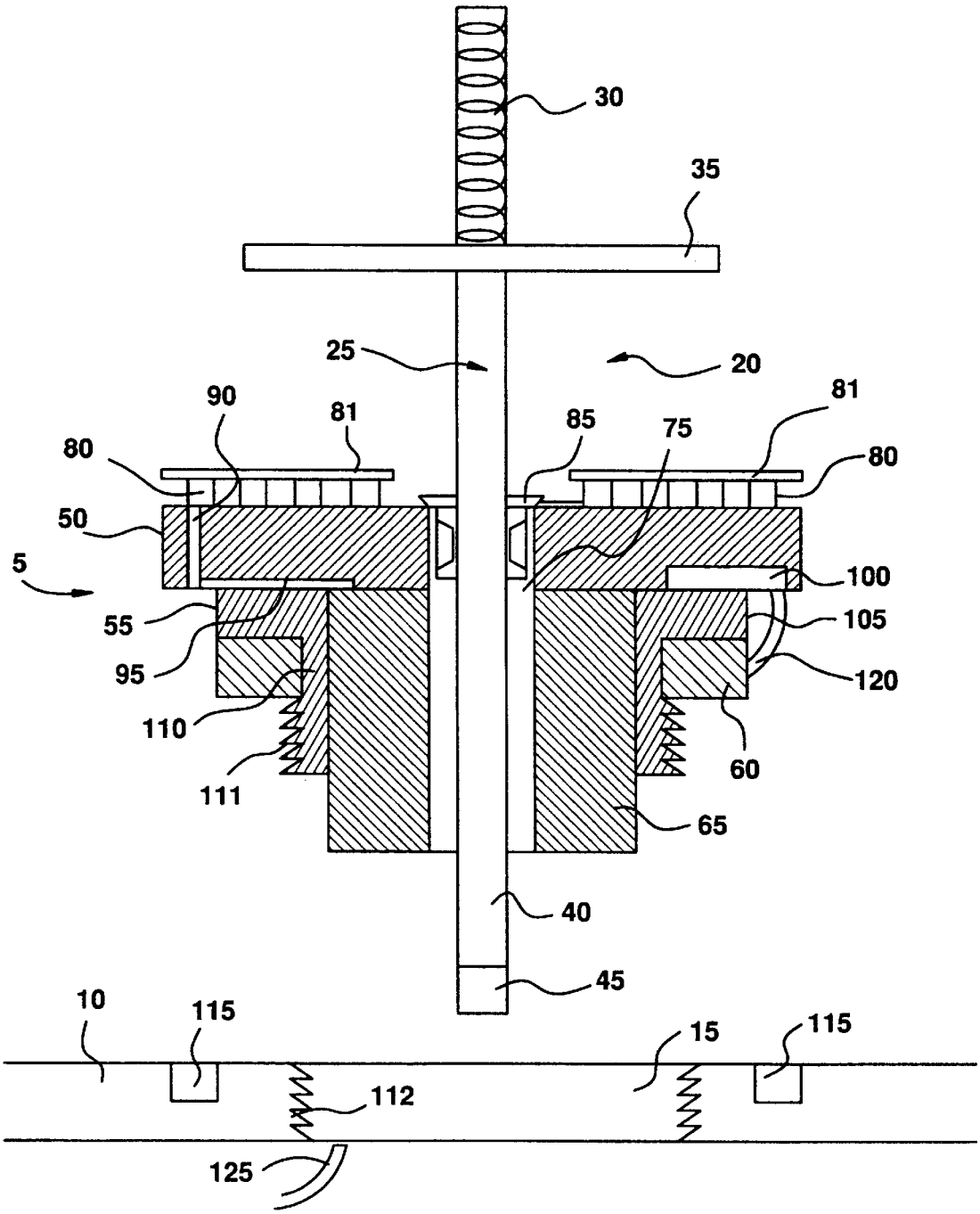
FIG. 1 is a cross-sectional side view of the impedance matching network of the present invention.

Referring now to the drawings, and more particularly, to FIG. 1, there is illustrated the antenna impedance matching network of the present invention. The apparatus consists of an impedance matching network assembly 5 that threadedly engages the housing 10 of a radio telephone through antenna port 15. Inserted through the impedance matching network assembly 5 is a retractable antenna 20. The antenna 20 comprises a quarter wavelength rod 25 connected to a quarter wavelength helical coil 30 by a conductive plate 35. The quarter wavelength rod 25 includes an insulated portion 40 and a metal contact 45 on its lower end.

The impedance matching network assembly 5 consists of the impedance matching network card 50, insulator 55, ground ring 60 and conductive sleeve 65. The impedance matching network card 50 is preferably constructed of an insulating printed circuit board material having a circular shape and defining an opening 75 therethrough for the antenna 20. While the present invention describes the impedance matching network card 50 with respect to the use of a circular shape and a printed circuit board material, any other shape or insulating material providing the characteristics to be discussed would be acceptable.

Figure 2A:
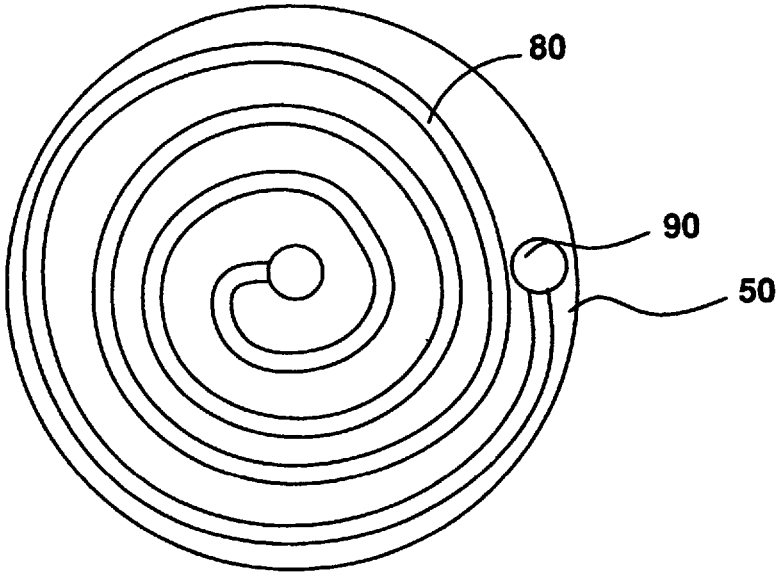
FIG. 2A is a top view of the impedance matching network card.

On the top surface (FIG. 2A) of the impedance matching network card 50 is defined a coil trace 80 that acts as a conductive coil. The coil trace 80 is made of copper or any other conductive material and interconnects an antenna connector 85 with a conductive via 90. The antenna connector 85 consists of a circular or other shaped metal contact having at least one protrusion extending toward the center of the antenna opening 75 to contact the antenna 20. Note, that while the coil trace 80 has been illustrated in a spiral shape, this is not necessarily required. Any shape of conductive coil would work, such as zig-zag, square, triangular or even a straight line. A tape layer 81 or other insulating material may cover the coil trace 80 to prevent electrical contact with the coil trace and to protect the coil trace from dust and other contaminants.

Figure 2B:
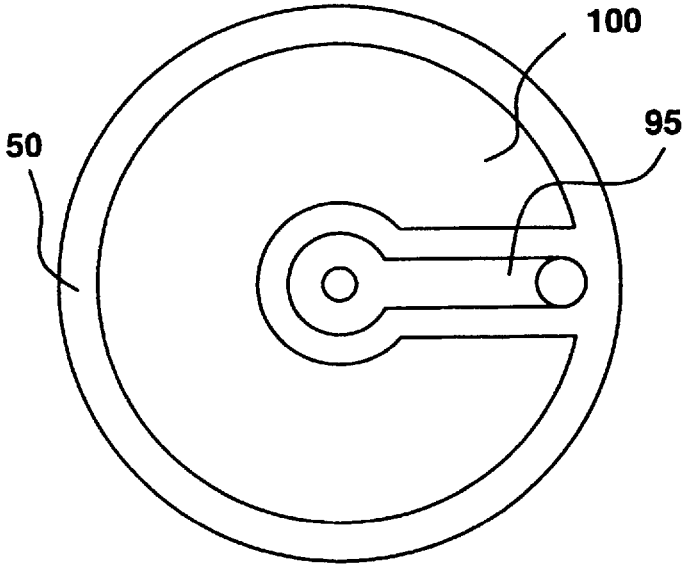
FIG. 2B is a bottom view of an impedance matching network card.

The conductive via 90 is a plated through-hole interconnecting the coil trace 80 on the upper surface of the network card 50 to a feed line 95 on the lower surface of the network card. As shown in FIG. 2B, the lower surface of the impedance matching network card 50 includes the feed line 95 connecting the conductive via 90 to a point for connection with a conductive sleeve 65. A ground trace 100 substantially surrounds the feed line 95, but does not touch it. The ground trace 100 covers substantially the entire bottom surface of the network card 50.

The network card 50 rests on top of the conductive sleeve 65 in such a manner that the conductive sleeve engages the feed line 95 but not the ground trace 100. The conductive sleeve 65 is a cylinder defining a passage therethrough for receiving the antenna 20. The conductive sleeve 65 is inserted through an insulator 55 such that the conductive sleeve 65 rests within the interior of the insulator 55 while the network card 50 rests on the top of the insulator. The insulator 55 comprises an annular disk 105 having a cylinder 110 extending from the bottom side thereof. The cylinder 110 defines a threaded portion 111 on its exterior surface for engaging a corresponding threaded portion 112 in the antenna port 15. The insulator 55 insulates the network card 50 and conductive sleeve 65 from the radio telephone housing 10.

A ground ring 60 is placed around the outside of the cylinder 110 of the insulator 55 and rests on the bottom surface of the annular disk 105. The ground ring 60 provides a connection between a conductive ground ring 115 on the surface of the radio telephone housing 10 and the ground trace 100 on the bottom surface of the network card 50. The ground ring 60 and ground trace 100 are connected by line 120.

When the impedance matching network assembly 5 is inserted into the antenna port 15 of the radio telephone housing 10, the conductive sleeve 65 engages an RF feed point 125. The RF feed point 125 is connected to the output of the RF amplifier (not shown) and provides approximately a 50 Ω output impedance. When the antenna 20 and impedance matching network assembly 5 are removed from the housing 10 of the radio telephone, the RF feed point 125 is accessible for testing procedures during manufacture of the radio telephone.

Figure 3:
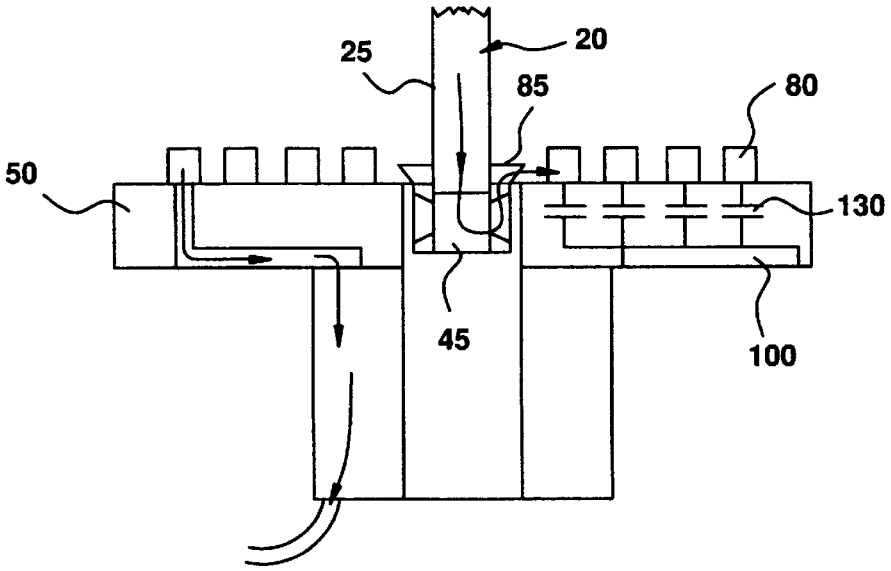
FIG. 3 illustrates the operation of the impedance matching circuit when the antenna is in the extended position.
Figure 4:
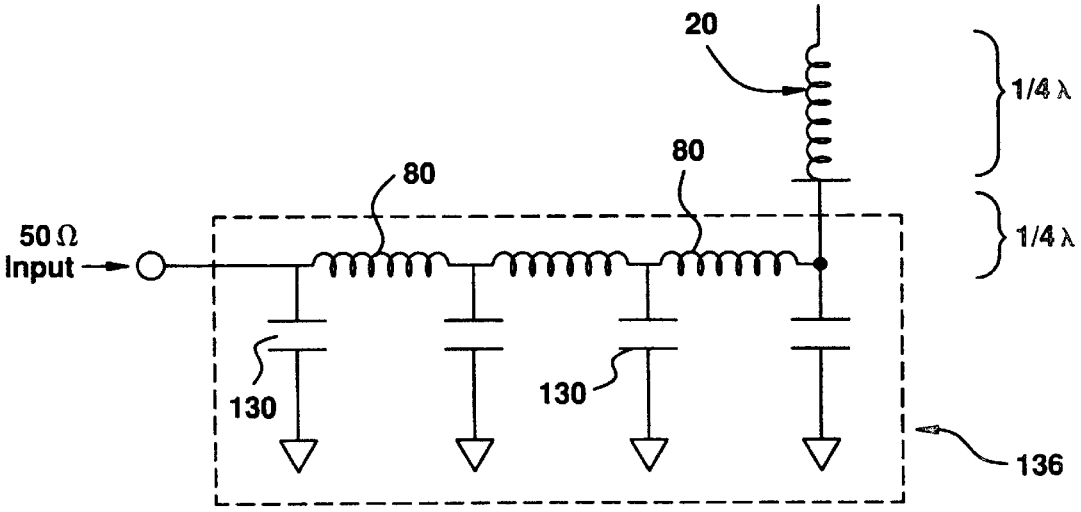
FIG. 4 is a schematic diagram illustrating the equivalent electrical circuit generated when the antenna is in the extended position.

Referring now to FIG. 3, there is illustrated the operation of the antenna matching impedance network of the present invention when the antenna 20 is in the extended position. When the antenna 20 is in the extended position, the metal contact 45 of the quarter wavelength antenna rod 25 has an electrical connection with the antenna connector 85 of the network card 50. This creates an electrical connection between the antenna 20 and the RF feed point 125 through the coil trace 80 on the top surface of the impedance matching network card 50. In the extended antenna configuration, the coil trace 80 on the top surface of the network card 50 and the ground plane 100 on the bottom surface of the network card have a distributed capacitance between them as shown generally by 130. This capacitance 130 combines with the inductance provided by coil trace 80 to create an impedance matching network 136 between the output of the RF amplifier and the antenna enabling maximum signal transfer between these elements. FIG. 4, illustrates the electrical equivalent circuit for the antenna in the extended position. The coil trace 80 and capacitance 130 between the coil trace and the ground trace 100 of the network card 50 act as a high impedance matching network 136 of inductors and capacitors to match the high impedance load of the extended antenna 20.

Figure 5:
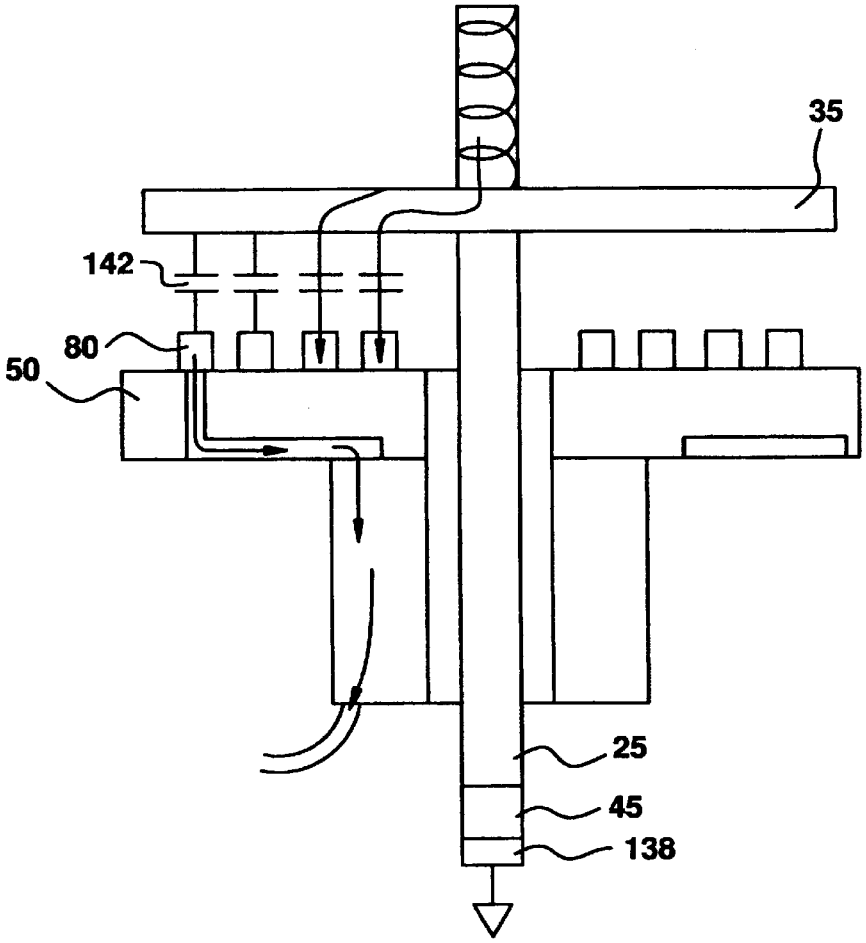
FIG. 5 illustrates the operation of the impedance matching circuit when the antenna is in the retracted position.

Referring now to FIG. 5, there is illustrated the operation of the matching network when the antenna is in the retracted position. When the antenna is placed in the retracted position, metal contact 45 of the quarter wavelength rod 25 contacts a ground point 138 grounding this portion of the antenna such that it does not effect the circuit. The retracted position places the conductive plate 35 in close proximity to the upper surface of the network card 50. The close proximity of the conductive plate 35 to the coil trace 80 creates a capacitive effect (shown generally at 142) between the conductive plate and the coil trace wherein the conductive plate composes one plate of a capacitor and the shorted coil trace forms the other plate of the capacitor.

The capacitive effect 142 between the plate 35 and the coil trace 80 effectively and reliably shorts adjacent spirals of the coil trace from the system such that the matching network is removed from the system without physical contact between the network card 50 and the conductive plate. The capacitive effect 142 between the conductive plate 35 and coil trace 80 generates an electrical equivalent circuit as shown in FIG. 6, wherein the antenna 20 and amplifier are connected by capacitors 140 and capacitors 145 short the matching network from the system.

Figure 6:
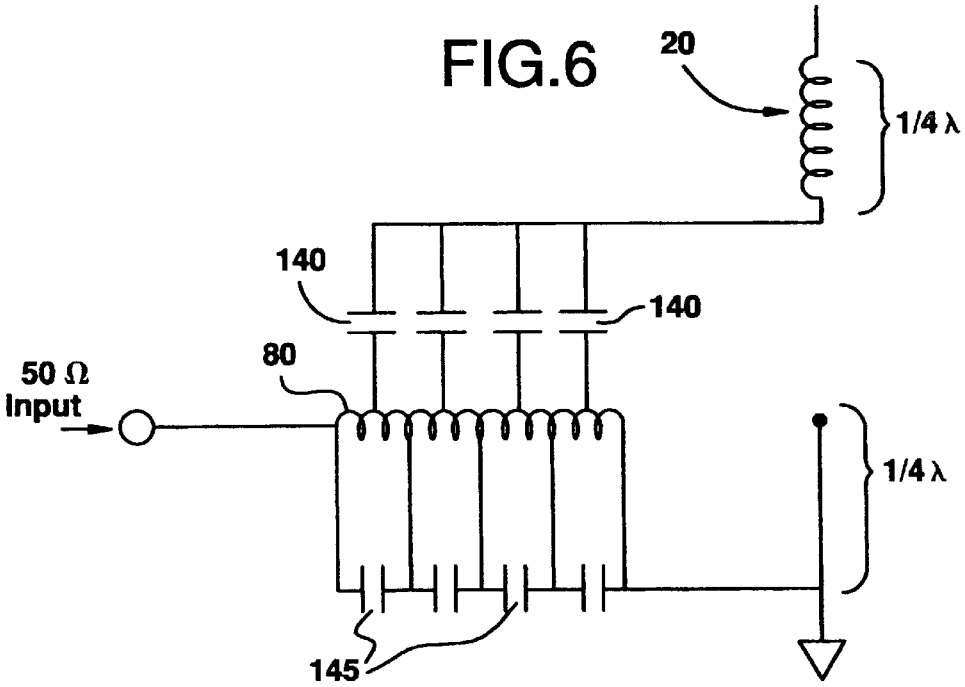
FIG. 6 is a schematic diagram illustrating the equivalent electrical circuit generated when the antenna is in the retracted position.

By altering the diameter of the conductive plate 35, the distance required to achieve the above-described circuit of FIG. 6 may be changed. When a larger diameter conductive plate 35 is used, the plate and coil trace 80 may be further apart and still create the above-described circuit. When using a smaller conductive plate 35 the plate and coil trace 80 must be closer together to generate the circuit.

Thus, the above-described invention enables a high impedance matching network to be connected between an antenna and an RF amplifier without requiring the use of electro-mechanical contacts. The effect is achieved by the mere proximity of a conductive disk to an etched coil on a nonconductive surface. Furthermore, by removing the antenna and impedance matching network assembly, a convenient 50 Ω RF feed point is provided for testing procedures.

Although an embodiment of the method and apparatus of the present invention has been illustrated in the accompanying Drawings and described in the foregoing Detailed Description, it will be understood that the invention is not limited to the embodiment disclosed, but is capable of numerous rearrangements, modifications and substitutions without departing from the spirit of the invention as set forth and defined by the following claims.

What is claimed is:

1. An antenna impedance matching network requiring no switch contacts to interconnect the network between an antenna and a circuit in a radio telephone, comprising:

a conductive plate connected to move with the antenna between a first and a second position, wherein the first position corresponds to an extended position of the antenna and the second position corresponds to a retracted position of the antenna;

a nonconductive plate having a conductive coil trace on a first side thereof and a ground trace on a second side thereof; and wherein location of the conductive plate in the first position connects an impedance matching network between the antenna and the circuit, the impedance matching network comprising the conductive coil trace and a capacitor formed between the conductive coil trace and the ground trace of the nonconductive plate and further wherein location of the conductive plate in the second position connects the antenna to the circuit through a capacitor, the capacitor having one plate formed by the conductive coil trace and a second plate formed by the conductive plate.

2. The network of claim 1, further including means for connecting the antenna to the conductive coil trace.

3. The network of claim 1, further including means for connecting the conductive coil trace to an RF feed point.

4. The network of claim 3 wherein the means for connecting comprises:

a feed trace defined on the second side of the nonconductive plate;

a conductive via interconnecting the feed trace with the conductive coil trace; and means for connecting the feed trace to the RF feed point.

5. The network of claim 1, further including means for interconnecting the ground trace to a ground plane of the circuit.

6. The network of claim 5, further including means for insulating the means for interconnecting from the second side of the nonconductive plate.

7. The network of claim 1 wherein the conductive coil trace has a spiral shape.

8. The network of claim 1 wherein the nonconductive plate comprises a printed circuit board.

9. An antenna system comprising:

an antenna moveable between an extended and a retracted position;

a conductive plate connected to the antenna and moveable between the extended and the retracted positions; and impedance matching means including an impedance matching circuit responsive to the position of the conductive plate such that location of the conductive plate in the extended position connects the impedance matching circuit between the antenna and a second circuit and location of the conductive plate in the retracted position short circuits the impedance matching circuit and provides a non-mechanical connection between the antenna and the second circuit.

10. The system of claim 9 wherein the impedance matching means comprises a non-conductive plate having a conductive coil trace on a first side thereof and a ground trace on a second side thereof.

11. The system of claim 10 wherein the impedance matching circuit comprises the conductive coil trace and a capacitor formed between the conductive coil trace and the ground trace of the non-conductive plate.

12. The system of claim 10 wherein the non-mechanical connection comprises a capacitor formed between the conductive plate and the conductive coil.

13. The network of claim 10, further including means for connecting the antenna to the conductive coil trace.

14. The network of claim 10, further including means for interconnecting the ground trace to a ground plane of the second circuit.

15. The network of claim 14, further including means for insulating the means for interconnecting from the second side of the nonconductive plate.

16. The network of claim 10 wherein the conductive coil trace has a spiral shape.

17. An antenna system comprising:

a retractable antenna moveable between an extended position and a retracted position;

a radio telephone housing defining an antenna port, the housing enclosing a second circuit;

an impedance matching circuit connected to the antenna port for matching the load impedance of the retractable antenna in the extended position to the second circuit, said impedance matching circuit including a non-conductive plate having a conductive coil trace on a first side thereof and a ground trace on a second side thereof such that the impedance matching circuit comprises the conductive coil trace and a capacitor formed between the conductive coil trace and the ground trace of the non-conductive plate; and means, associated with the retractable antenna to move between the extended position and the retracted position, for disabling the impedance matching circuit, wherein location of the means for disabling in the retracted position short circuits the impedance matching circuit and provides a capacitive connection between the antenna and the second circuit.

18. The system of claim 17 wherein the capacitive connection comprises a capacitor formed between the ground trace and the conductive coil.

19. The network of claim 17 wherein the conductive coil trace has a spiral shape.

20. The network of claim 17 wherein the nonconductive plate comprises a printed circuit board.

* * * * *